US008268768B2

(12) United States Patent
Sendor-Muller et al.

(10) Patent No.: US 8,268,768 B2
(45) Date of Patent: Sep. 18, 2012

(54) AUTOMATIC DISHWASHING AGENT

(75) Inventors: Dorota Sendor-Muller, Dusseldorf (DE); Johannes Zipfel, Dusseldorf (DE); Arnd Kessler, Monheim am Rhein (DE); Christian Nitsch, Dusseldorf (DE); Sven Muller, Duisburg (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/161,269

(22) Filed: Jun. 15, 2011

(65) Prior Publication Data

US 2011/0240063 A1 Oct. 6, 2011

Related U.S. Application Data

(63) Continuation of application No. PCT/EP2009/067038, filed on Dec. 14, 2009.

(30) Foreign Application Priority Data

Dec. 19, 2008 (DE) ..... 10 2008 063 801

(51) Int. Cl.
*C11D 17/00* (2006.01)

(52) U.S. Cl. ..... 510/228; 510/439; 134/25.2

(58) Field of Classification Search ..... 510/228, 510/439; 134/25.2
See application file for complete search history.

(56) References Cited

U.S. PATENT DOCUMENTS

| | | | | |
|---|---|---|---|---|
| 4,704,233 | A | 11/1987 | Hartman et al. | |
| 5,968,881 | A * | 10/1999 | Haeggberg et al. | 510/226 |
| 7,469,519 | B2 * | 12/2008 | Barthel et al. | 53/433 |
| 2004/0266650 | A1 * | 12/2004 | Lambotte et al. | 510/438 |
| 2005/0020469 | A1 * | 1/2005 | Rahse et al. | 510/444 |
| 2006/0223738 | A1 * | 10/2006 | Holderbaum et al. | 510/439 |
| 2007/0054829 | A1 * | 3/2007 | Gentschev et al. | 510/302 |
| 2007/0203047 | A1 * | 8/2007 | Pegelow et al. | 510/421 |

FOREIGN PATENT DOCUMENTS

| | | | |
|---|---|---|---|
| EP | 0692020 | B1 | 11/1997 |
| EP | 0662117 | B1 | 6/2000 |
| EP | 0906407 | B1 | 9/2001 |
| EP | 1113070 | B1 | 3/2008 |
| JP | 2006265463 | A | 10/2006 |
| WO | WO96/06908 | A1 | 3/1996 |
| WO | WO2006/029806 | A1 | 3/2006 |
| WO | WO2008/017620 | A1 | 2/2008 |

OTHER PUBLICATIONS

PCT International Search Report (PCT/EP2009/067038) dated Feb. 19, 2010.

* cited by examiner

*Primary Examiner* — Gregory Webb
(74) *Attorney, Agent, or Firm* — David K. Benson

(57) ABSTRACT

The invention relates to a phosphate- and bleach-free automatic dishwashing agent containing: a) 5 to 60 wt % citrate, b) (hydrogen) carbonate, c) 2 to 40 wt % ethylenediamine disuccinic acid, wherein the weight ratio of the components b) and c) is between 1:5 and 10:1, and wherein said automatic dishwashing agent is characterized by good cleaning performance, particularly improved cleaning of tea.

14 Claims, No Drawings

AUTOMATIC DISHWASHING AGENT

CROSS-REFERENCES TO RELATED APPLICATIONS

This is a continuation of International Application No. PCT/EP2009/067038, filed Dec. 14, 2009, which claims priority to German Patent Application No. DE 10 2008 063 801.3 filed Dec. 19, 2008, both of which are hereby incorporated by reference.

FIELD OF THE INVENTION

The present invention generally relates to automatic dishwashing agents, automatic dishwashing methods using these dishwashing agents, and the use of these dishwashing agents to improve the cleaning performance in automatic dishwashing.

BACKGROUND OF THE INVENTION

Cleanliness expectations for automatically washed dishes are often higher than those for manually washed dishes. Dishes which at first glance appear to be entirely free from food residues are then rated as not perfect if, after automatic dishwashing, stains still remain. Such stains may be based, for example, on the accretion of vegetable dyes on the dish surfaces.

Bleaching agents are conventionally used in automatic dishwashing agents in order to obtain spotless dishes. To activate these bleaching agents, and to achieve an improved bleaching action when cleaning at temperatures of 60° C. and below, automatic dishwashing agents generally also contain bleach activators. Bleach catalysts are often added to automatic dishwashing agents and have proved to be especially effective.

There are, however, limits to the use of these bleaching agents because of incompatibilities with other active washing or cleaning ingredients such as enzymes, or because of stability problems in the storage of washing and cleaning agents containing bleaching agents. This applies in particular also to liquid washing or cleaning agents.

One technical potential solution for improving the cleaning performance of automatic dishwashing agents, in particular of bleaching agent-free automatic dishwashing One technical potential solution for improving the cleaning performance of automatic dishwashing agents, in particular of bleaching agent-free automatic dishwashing agents, includes increasing the alkalinity of these agents. For that reason the automatic dishwashing agents intended for private end consumers contain builders as a substantial constituent for both successful cleaning and rinsing. These builders firstly increase the alkalinity of the cleaning liquor since fats and oils are emulsified and saponified with increasing alkalinity, and secondly reduce the water hardness of the cleaning liquor by complexing the calcium ions contained in the aqueous liquor. Alkali phosphates have proved to be particularly effective builders, and for that reason they form the main constituent of the overwhelming majority of commercially available automatic dishwashing agents.

While phosphates are thus very highly valued in terms of their advantageous effect as a constituent of automatic dishwashing agents, their use is however not without problems from an environmental protection perspective. A substantial part of the phosphate finds its way into water bodies via domestic sewage, and in standing water bodies in particular (lakes, barrages), effectively playing a serious role in their overfertilization. As a consequence of this phenomenon, which is also known as eutrophication, the use of pentasodium triphosphate in textile washing agents has been considerably reduced through statutory regulations in many countries, for example USA, Canada, Italy, Sweden, Norway, and banned altogether in Switzerland. In Germany the maximum content of this builder in washing agents has been limited to 20% since 1984.

Along with nitrilotriacetic acid, sodium aluminum silicates (zeolites) above all are used as phosphate substitute or replacement substances in textile washing agents. For various reasons, however, these substances are not suitable for use in automatic dishwashing agents. A number of substitute substances have therefore been discussed in the literature as alternatives to alkali phosphates in automatic dishwashing agents, of which citrates should be mentioned in particular.

Phosphate-free automatic dishwashing agents which in addition to a citrate also contain carbonates, bleaching agents and enzymes are described for example in the European patents EP 662 117 B1 (Henkel KGaA) and EP 692 020 B1 (Henkel KGaA).

Another alternative to alkali phosphates, which as sole builder however is preferably used in combination with citrates, is methylglycinediacetic acid (MGDA). Automatic dishwashing agents containing MGDA are described for example in the European patent EP 906 407 B1 (Reckitt Benckiser) or in the European patent application EP 1 113 070 A2 (Reckitt Benckiser).

Despite the efforts to date, manufacturers of automatic dishwashing agents have so far not succeeded in providing phosphate-free automatic dishwashing agents that are superior or even comparable to phosphate-containing cleaning agents in terms of their cleaning and rinsing performance and particularly in terms of their deposit-inhibiting performance. Such performance parity is however a condition for the successful market launch of phosphate-free cleaning agents, as the overwhelming majority of end consumers, despite broad public debate on environmental issues, will typically decide against an ecologically advantageous product if it does not reach the market standard in terms of its price and/or performance.

A further technical possibility for improving the cleaning performance of automatic dishwashing agents consists in the use of bleaching agents. To activate these bleaching agents, and to achieve an improved bleaching action when cleaning at temperatures of 60° C. and below, automatic dishwashing agents generally also contain bleach activators or bleach catalysts, bleach catalysts in particular having proved to be especially effective.

There are however limits to the use of these bleaching agents because of incompatibilities with other active washing or cleaning ingredients such as enzymes, or because of stability problems in the storage of washing and cleaning agents containing bleaching agents. This applies in particular also to liquid washing or cleaning agents.

Accordingly, it is desirable to provide phosphate- and bleaching agent-free automatic dishwashing agents which have the characteristic feature of an improved cleaning profile in terms of typical bleach-sensitive soiling such as tea stains. Performance-improving cleaning agents and corresponding cleaning methods should therefore be made available.

This object is achieved through the addition of ethylenediamine disuccinic acid to a carbonate-containing cleaning agent formulation based on citrate. Phosphate-free automatic dishwashing agents containing ethylenediamine disuccinic acid as a complexing agent are described for example in the world patent application WO 2006/029806 A1 (BASF). Furthermore, other desirable features and characteristics of the present invention will become apparent from the subsequent detailed description of the invention and the appended claims.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The present application firstly provides a phosphate- and bleaching agent-free automatic dishwashing agent containing:

a) 5 to 60 wt. % of citrate b) (hydrogen) carbonate c) 2 to 40 wt. % of ethylenediamine disuccinic acid wherein the weight ratio of components b) and c) is between 1:5 and 10:1.

The automatic dishwashing agents according to the invention have a low alkali content. Preferred automatic dishwashing agents according to the invention have the characteristic feature that the automatic dishwashing agent has a pH (10% solution; 20° C.) of between 9 and 11.5, preferably between 9.5 and 11.5.

A first substantial constituent of agents according to the invention is citrate. The term "citrate" likewise encompasses citric acid and salts thereof, in particular alkali metal salts thereof. Particularly preferred automatic dishwashing agents according to the invention contain, relative to their total weight, 5 to 50 wt. %, preferably 5 to 40 wt. % and in particular 5 to 30 wt. % of citrate.

In addition to citrates, the automatic dishwashing agents according to the invention contain carbonates and/or hydrogen carbonates as additional builders. In the context of this application the group of carbonates and hydrogen carbonates is encompassed by the term (hydrogen) carbonate.

The use of (hydrogen) carbonate(s), preferably alkali (hydrogen) carbonate(s), particularly preferably sodium (hydrogen) carbonate or potassium (hydrogen) carbonate, in amounts of 2.0 to 50 wt. %, preferably 4.0 to 45 wt. % and in particular 8.0 to 40 wt. %, relative to the total weight of the automatic dishwashing agent, is particularly preferred.

The automatic dishwashing agents according to the invention contain as the third substantial constituent ethylenediamine disuccinic acid (EDDS), wherein preferred automatic dishwashing agents contain, relative to their total weight, 3.0 to 35 wt. %, preferably 4.0 to 30 wt. % and in particular 8.0 to 25 wt. % of ethylenediamine disuccinic acid.

In addition to the free acids, the term "ethylenediamine disuccinic acid" (EDDS) also encompasses salts thereof, including sodium or potassium salts thereof. Regarding the percentage by weight of ethylenediamine disuccinic acid used in the agents according to the invention, if the acid salt is used then the percentage by weight of the free acid should be taken as a basis, in other words the percentage by weight of the salt should be converted to the percentage by weight of the acid.

Regarding the increase in tea stain removal performance of automatic dishwashing agents according to the invention, the weight ratio of the constituents (hydrogen) carbonate b) and ethylenediamine disuccinic acid c) used in these agents has proved to be substantial. By maintaining specific weight ratios, the tea stain removal performance of the automatic dishwashing agents according to the invention can be improved, wherein weight ratios of the components (hydrogen) carbonate b) and ethylenediamine disuccinic acid c) of between 3:5 and 8:1, preferably between 1:1 and 6:1 and in particular between 1:1 and 4:1 have proved to be particularly advantageous.

Some further formulations by way of example of preferred automatic dishwashing agents according to the invention can be found in the table below:

| Ingredient | Form. 1 [wt. %] | Form. 2 [wt. %] | Form. 3 [wt. %] | Form. 4 [wt. %] |
|---|---|---|---|---|
| Citrate | 5 to 60 | 5 to 50 | 5 to 40 | 5 to 30 |
| (Hydrogen) carbonate | 1) | 2) | 2) | 3) |
| EDDS | 3.0 to 35 | 3.0 to 35 | 4.0 to 30 | 8 to 25 |
| Phosphate | — * | — | — | — |
| Bleaching agent | — | — | — | — |
| Misc | to 100 | to 100 | to 100 | to 100 |

1) Weight ratios of (hydrogen) carbonate b) and EDDS c) between 3:5 and 8:1

2) Weight ratios of (hydrogen) carbonate b) and EDDS c) between 1:1 and 6:1

3) Weight ratios of (hydrogen) carbonate b) and EDDS c) between 1:1 and 4:1

* In this and all subsequent tables, "—" means that the formulation is free from this constituent Surprisingly it was found that the tea stain removal performance of automatic dishwashing agents according to the invention can be improved by the addition of polymers containing sulfonic acid groups. Preferred automatic dishwashing agents therefore have the characteristic feature that they contain, relative to their total weight, 2.0 to 20 wt. %, preferably 2.5 to 15 wt. % and in particular 2.5 to 10 wt. % of anionic copolymer, comprising i) mono- or polyunsaturated monomers from the group of carboxylic acids ii) mono- or polyunsaturated monomers from the group of sulfonic acids, and iii) optionally further ionic or non-ionic monomers.

Unsaturated carboxylic acids of the formula $R^1(R^2)C{=}C(R^3)COOH$, in which $R^1$ to $R^3$ independently of one another denote —H, —$CH_3$, a straight-chain or branched saturated alkyl residue having 2 to 12 carbon atoms, a straight-chain or branched, mono- or polyunsaturated alkenyl residue having 2 to 12 carbon atoms, alkyl or alkenyl residues substituted with -$NH_2$, —OH or —COOH as defined above, or —COOH or —$COOR^4$, wherein $R^4$ is a saturated or unsaturated, straight-chain or branched hydrocarbon residue having 1 to 12 carbon atoms, are used to particular advantage as unsaturated carboxylic acid(s).

Particularly preferred unsaturated carboxylic acids are acrylic acid, methacrylic acid, ethacrylic acid, α-chloroacrylic acid, α-cyanoacrylic acid, crotonic acid, α-phenyl acrylic acid, maleic acid, maleic anhydride, fumaric acid, itaconic acid, citraconic acid, methylene malonic acid, sorbic acid, cinnamic acid or mixtures thereof. The unsaturated dicarboxylic acids can also be used of course.

Of the monomers containing sulfonic acid groups, those of the formula $$R^5(R^6)C{=}C(R^7)—X—SO_3H$$

are preferred, in which $R^5$ to $R^7$ independently of one another denote —H, —$CH_3$, a straight-chain or branched saturated alkyl residue having 2 to 12 carbon atoms, a straight-chain or branched, mono- or polyunsaturated alkenyl residue having 2 to 12 carbon atoms, alkyl or alkenyl residues substituted with —$NH_2$, —OH or —COOH, or —COOH or —$COOR^4$, wherein $R^4$ is a saturated or unsaturated, straight-chain or branched hydrocarbon residue having 1 to 12 carbon atoms, and X denotes an optionally present spacer group, which is selected from —$(CH_2)_n$— where n=0 to 4, —COO—

$(CH_2)_k$— where k=1 to 6, —C(O)—NH—$C(CH_3)_2$— and —C(O)—NH—$CH(CH_2CH_3)$—.

Of these monomers those of the formulae $$H_2C{=}CH{-}X{-}SO_3H$$

$$H_2C{=}C(CH_3){-}X{-}SO_3H$$

$$HO_3S{-}X{-}(R^6)C{=}C(R^7){-}X{-}SO_3H$$

are particularly preferred, in which $R^6$ and $R^7$ are selected independently of each other from —H, —$CH_3$, —$CH_2CH_3$, —$CH_2CH_2CH_3$, —$CH(CH_3)_2$ and X denotes an optionally present spacer group, which is selected from —$(CH_2)_n$— where n=0 to 4, —COO—$(CH_2)_k$— where k=1 to 6, —C(O)—NH—$C(CH_3)_2$— and —C(O)—NH—$CH(CH_2CH_3)$—.

Particularly preferred monomers containing sulfonic acid groups are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allyl sulfonic acid, methallyl sulfonic acid, allyloxybenzenesulfonic acid, methallyloxybenzenesulfonic acid, 2-hydroxy-3-(2-propenyloxy)propanesulfonic acid, 2-methyl-2-propene 1-sulfonic acid, styrenesulfonic acid, vinylsulfonic acid, 3-sulfopropyl acrylate, 3-sulfopropyl methacrylate, sulfomethacrylamide, sulfomethyl methacrylamide and mixtures of the cited acids or water-soluble salts thereof.

The sulfonic acid groups can be present in the polymers wholly or partially in neutralized form, i.e. the acid hydrogen atom of the sulfonic acid group in some or all sulfonic acid groups can be exchanged for metal ions, preferably alkali metal ions, and in particular for sodium ions. The use of partially or completely neutralized sulfonic-acid-group-containing copolymers is preferred according to the invention.

The monomer distribution of the polymeric sulfonates preferably used according to the invention, in the case of copolymers containing only monomers from the groups of unsaturated carboxylic acids i) and unsaturated sulfonic acids ii), is preferably 5 to 95 wt. % of i) and ii) respectively, particularly preferably 50 to 90 wt. % of monomer from group ii) and 10 to 50 wt. % of monomer from group i), relative in each case to the polymer.

The molar mass of the sulfo copolymers preferably used according to the invention can be varied in order to adjust the properties of the polymers to the desired application. Preferred automatic dishwashing agents have the characteristic feature that the copolymers have molar masses of 2000 to 200,000 $gmol^{-1}$, preferably 4000 to 25,000 pike and in particular 5000 to 15,000 $gmol^{-1}$.

In a further preferred embodiment, the polymeric sulfonates comprise, in addition to the carboxyl group-containing monomer and sulfonic acid-group containing monomer, at least one non-ionic, preferably hydrophobic monomer. The use of these hydrophobically modified polymers has made it possible to improve in particular the rinsing performance of automatic dishwashing agents according to the invention.

Monomers of the general formula $R^1(R^2)C{=}C(R^3){-}X{-}R^4$ are preferably used as non-ionic monomers, in which $R^1$ to $R^3$ independently of one another denote —H, —$CH_3$ or —$C_2H_5$, X denotes an optionally present spacer group, which is selected from —$CH_2$—, —C(O)O— and —C(O)—NH—, and $R^4$ denotes a straight-chain or branched, saturated alkyl residue having 2 to 22 carbon atoms or an unsaturated, preferably aromatic residue having 6 to 22 carbon atoms.

Particularly preferred non-ionic monomers are butene, isobutene, pentene, 3-methylbutene, 2-methylbutene, cyclopentene, hexene, hexene-1,2-methylpentene-1,3-methylpentene-1, cyclohexene, methylcyclopentene, cycloheptene, methylcyclohexene, 2,4,4-trimethylpentene-1, 2,4,4-trimethylpentene-2,2,3-dimethylhexene-1,2,4-dimethylhexene-1,2,5-dimethylhexene-1,3,5-dimethylhexene-1,4,4-dimethylhexane-1, ethylcyclohexyne, 1-octene, α-olefins having 10 or more carbon atoms, such as for example 1-decene, 1-dodecene, 1-hexadecene, 1-octadecene and C22-α-olefin, 2-styrene, α-methylstyrene, 3-methylstyrene, 4-propylstyrene, 4-cyclohexylstyrene, 4-dodecylstyrene, 2-ethyl-4-benzylstyrene, 1-vinylnaphthalene, 2-vinylnaphthalene, methyl acrylate, ethyl acrylate, propyl acrylate, butyl acrylate, pentyl acrylate, hexyl acrylate, methyl methacrylate, N-(methyl) acrylamide, 2-ethylhexyl acrylate, 2-ethylhexyl methacrylate, N-(2-ethylhexyl)acrylamide, octyl acrylate, octyl methacrylate, N-(octyl)acrylamide, lauryl acrylate, lauryl methacrylate, N-(lauryl)acrylamide, stearyl acrylate, stearyl methacrylate, N-(stearyl)acrylamide, behenyl acrylate, behenyl methacrylate and N-(behenyl)acrylamide or mixtures thereof.

Some further formulations by way of example of preferred automatic dishwashing agents according to the invention can be found in the table below:

| Ingredient | Form. 1 [wt. %] | Form. 2 [wt. %] | Form. 3 [wt. %] | Form. 4 [wt. %] |
|---|---|---|---|---|
| Citrate | 5 to 60 | 5 to 50 | 5 to 40 | 5 to 30 |
| (Hydrogen) carbonate | 1) | 2) | 2) | 3) |
| EDDS | 3.0 to 35 | 3.0 to 35 | 4.0 to 30 | 8 to 25 |
| Sulfo copolymer | 2 to 20 | 2.0 to 20 | 2.0 to 20 | 2.5 to 15 |
| Phosphate | — | — | — | — |
| Bleaching agent | — | — | — | — |
| Misc | to 100 | to 100 | to 100 | to 100 |

1) Weight ratios of (hydrogen) carbonate b) and EDDS c) between 3:5 and 8:1
2) Weight ratios of (hydrogen) carbonate b) and EDDS c) between 1:1 and 6:1
3) Weight ratios of (hydrogen) carbonate b) and EDDS c) between 1:1 and 4:1

In addition to the builders described above, the agents according to the invention preferably also contain at least one organic cobuilder. Polycarboxylates/polycarboxylic acids, dextrins and phosphonates can be mentioned in particular as organic cobuilders. These classes of substances are described below.

Organic builder substances which can be used are for example the polycarboxylic acids which can be used in the form of the free acid and/or its sodium salts, polycarboxylic acids being understood to be those carboxylic acids carrying more than one acid function. These are for example adipic acid, succinic acid, glutaric acid, malic acid, tartaric acid, maleic acid, fumaric acid, sugar acids, aminocarboxylic acids, nitrilotriacetic acid (NTA), provided that such a use is not to be opposed on ecological grounds, and mixtures thereof. In addition to their builder action, the free acids typically also have the characteristic of an acidifying component and are thus also used to establish a lower and milder pH in washing or cleaning agents. Succinic acid, glutaric acid, adipic acid, gluconic acid and any mixtures thereof are to be cited here in particular.

Preferred automatic dishwashing agents according to the invention contain less than 1 wt. %, preferably less than 0.5 wt. % and in particular less than 0.1 wt. % of methylglycinediacetic acid (MGDA) or salts thereof. Most particularly preferred automatic dishwashing agents according to the invention are free from methylglycinediacetic acid or salts thereof.

The complexing phosphonates include in addition to 1-hydroxyethane-1,1-diphosphonic acid a series of different compounds such as for example diethylenetriamine penta(methylene phosphonic acid) (DTPMP). Hydroxyalkane and aminoalkane phosphonates in particular are preferred in this application. Of particular importance as a cobuilder among the hydroxyalkane phosphonates is 1-hydroxyethane-1,1-diphosphonate (HEDP). It is preferably used as a sodium salt, wherein the disodium salt reacts neutral and the tetrasodium salt reacts alkaline (pH 9). Ethylenediamine tetramethylene phosphonate (EDTMP), diethylenetriamine pentamethylene phosphonate (DTPMP) and the higher homologs thereof are preferably suitable as aminoalkane phosphonates. They are preferably used in the form of the neutral-reacting sodium salts, for example as hexasodium salt of EDTMP or as heptasodium and octasodium salt of DTPMP. From the class of phosphonates HEDP is preferably used as the builder. The aminoalkane phosphonates additionally have a pronounced heavy-metal-binding capacity. It can accordingly be preferable to use aminoalkane phosphonates, in particular DTPMP, or mixtures of the cited phosphonates, particularly if the agents also contain bleach.

A preferred automatic dishwashing agent within the context of this application contains one or more phosphonates from the group of a) amino trimethylene phosphonic acid (ATMP) and/or salts thereof;

b) ethylenediamine tetra(methylene phosphonic acid) (EDTMP) and/or salts thereof;

c) diethylenetriamine penta(methylene phosphonic acid) (DTPMP) and/or salts thereof;

d) 1-hydroxyethane-1,1-diphosphonic acid (HEDP) and/or salts thereof;

e) 2-phosphonobutane-1,2,4-tricarboxylic acid (PBTC) and/or salts thereof;

f) hexamethylenediamine tetra(methylene phosphonic acid) (HDTMP) and/or salts thereof; and g) nitrilotri(methylene phosphonic acid) (NTMP) and/or salts thereof.

Automatic dishwashing agents containing 1-hydroxyethane-1,1-diphosphonic acid (HEDP) or diethylenetriamine penta(methylene phosphonic acid) (DTPMP) are particularly preferred.

The automatic dishwashing agents according to the invention can of course contain two or more different phosphonates.

The percentage by weight of phosphonates in the total weight of automatic dishwashing agents according to the invention is preferably 1 to 8 wt .%, preferably 1.2 to 6 wt. % and in particular 1.5 to 4 wt. %.

Some further formulations by way of example of preferred automatic dishwashing agents according to the invention can be found in the tables below:

| Ingredient | Form. 1 [wt. %] | Form. 2 [wt. %] | Form. 3 [wt. %] | Form. 4 [wt. %] |
|---|---|---|---|---|
| Citrate (Hydrogen) carbonate | 5 to 60 1) | 5 to 50 2) | 5 to 40 2) | 5 to 30 3) |
| EDDS | 3.0 to 35 | 3.0 to 35 | 4.0 to 30 | 8 to 25 |
| Phosphonate | 1 to 8 | 1 to 8 | 1.2 to 6 | 1.2 to 6 |
| Sulfo copolymer | 0 to 20 | 0 to 20 | 0 to 20 | 0 to 20 |
| Phosphate | — | — | — | — |
| Bleaching agent | — | — | — | — |
| Misc | to 100 | to 100 | to 100 | to 100 |

| Ingredient | Form. 5 [wt. %] | Form. 6 [wt. %] | Form. 7 [wt. %] | Form. 8 [wt. %] |
|---|---|---|---|---|
| Citrate (Hydrogen) carbonate | 5 to 60 1) | 5 to 50 2) | 5 to 40 2) | 5 to 30 3) |
| EDDS | 3.0 to 35 | 3.0 to 35 | 4.0 to 30 | 8 to 25 |
| Phosphonate | 1 to 8 | 1 to 8 | 1.2 to 6 | 1.2 to 6 |
| Sulfo copolymer | 2 to 20 | 2.0 to 20 | 2.0 to 20 | 2.5 to 15 |
| Phosphate | — | — | — | — |
| Bleaching agent | — | — | — | — |
| Misc | to 100 | to 100 | to 100 | to 100 |

1) Weight ratios of (hydrogen) carbonate b) and EDDS c) between 3:5 and 8:1

2) Weight ratios of (hydrogen) carbonate b) and EDDS c) between 1:1 and 6:1

3) Weight ratios of (hydrogen) carbonate b) and EDDS c) between 1:1 and 4:1

Preferred automatic dishwashing agents according to the invention contain alkali hydroxide(s) to increase or adjust the alkalinity. The alkali hydroxides are preferably used in the cleaning agents in amounts below 12 wt. %, preferably between 2 and 10 wt. % and in particular between 3 and 8 wt. %, relative in each case to the total weight of the cleaning agent.

Preferred automatic dishwashing agents according to the invention contain less than 2 wt. %, preferably less than 1 wt. % and in particular less than 0.5 wt. % of silicate. Most particularly preferred automatic dishwashing agents according to the invention are silicate-free.

Automatic dishwashing agents according to the invention can contain enzyme(s) as a further constituent. These include in particular proteases, amylases, lipases, hemicellulases, cellulases, perhydrolases or oxidoreductases, and preferably mixtures thereof. These enzymes are of natural origin in principle; starting from the natural molecules, improved variants are available for use in washing or cleaning agents which accordingly are preferably used. Washing or cleaning agents preferably contain enzymes in total amounts of $1\times10^{-6}$ to 5 wt. %, relative to active protein. The protein concentration can be determined with the aid of known methods, for example the BCA method or the Biuret method.

Of the proteases, those of the subtilisin type are preferred. Examples thereof are the subtilisins BPN' and Carlsberg and the developed forms thereof, the protease PB92, the subtilisins 147 and 309, the alkaline protease from *Bacillus lentus*, subtilisin DY, and the enzymes thermitase, proteinase K and the proteases TW3 and TW7, which can be assigned to the subtilases but no longer in the narrower sense to the subtilisins.

Examples of amylases which can be used according to the invention are the α-amylases from *Bacillus licheniformis*, from *B. amyloliquefaciens*, from *B. stearothermophilus*, from *Aspergillus niger* and *A. oryzae*, and the developed forms of the aforementioned amylases improved for use in washing and cleaning agents. Furthermore, the α-amylase from *Bacillus* sp. A 7-7 (DSM 12368) and the cyclodextrin glucanotransferase (CGTase) from *B. agaradherens* (DSM 9948) can be mentioned for this purpose.

Also suitable for use according to the invention are lipases or cutinases, in particular because of their triglyceride-cleaving activities but also in order to produce peracids in situ from suitable precursors. These include for example the lipases obtainable originally from *Humicola lanuginosa* (*Thermomyces lanuginosus*) or the developed forms thereof, in particular those with the amino acid exchange D96L.

Enzymes which are grouped together under the term hemicellulases can moreover be used. They include for example mannanases, xanthan lyases, pectin lyases (=pectinases), pectinesterases, pectate lyases, xyloglucanases (=xylanases), pullulanases and β-glucanases.

To increase the bleaching action, oxidoreductases, for example oxidases, oxygenases, catalases, peroxidases, such as halo-, chloro-, bromo-, lignin, glucose or manganese peroxidases, dioxygenases or laccases (phenoloxidases, polyphenoloxidases) can be used according to the invention, Preferably organic, particularly preferably aromatic compounds which interact with the enzymes are advantageously additionally added to strengthen the activity of the oxidoreductases concerned (enhancers) or to ensure the flow of electrons in the case of very differing redox potentials between the oxidizing enzymes and the stains (mediators).

A protein and/or enzyme can be protected against damage, particularly during storage, such as for example inactivation, denaturation or decomposition due to physical influences, oxidation or proteolytic cleavage for instance. If the proteins and/or enzymes are obtained by microbial means, an inhibition of proteolysis is particularly preferred, particularly if the agents also contain proteases. Washing or cleaning agents can contain stabilizers to this end; the provision of such agents is a preferred embodiment of the present invention.

Active washing or cleaning proteases and amylases are generally used not in the form of the pure protein but rather in the form of stabilized preparations which are capable of being stored and transported. Examples of these ready-to-use preparations include the solid preparations obtained by granulation, extrusion or lyophilization or, particularly in the case of agents in liquid or gel form, solutions of the enzymes, advantageously as concentrated as possible, with a low water content and/or mixed with stabilizers or other auxiliary agents.

For both solid and liquid product forms, the enzymes can alternatively be encapsulated, for example by spray drying or extrusion of the enzyme solution together with a preferably natural polymer, or in the form of capsules, for example those in which the enzymes are enclosed as in a solidified gel or in those of the core-shell type, in which an enzyme-containing core is coated with a protective layer which is impermeable to water, air and/or chemicals. Further active ingredients, for example stabilizers, emulsifiers, pigments, bleaches or dyes, can additionally be applied in superimposed layers. Such capsules are applied by methods known per se, for example by vibrating or roll granulation or in fluidized-bed processes.

Such granules are preferably low in dust, for example through the application of polymeric film formers, and stable in storage because of the coating.

It is also possible to make up two or more enzymes together so that a single granulated product has multiple enzyme activities.

A preferred automatic dishwashing agent according to the invention has the characteristic feature that, relative to its total weight, the dishwashing agent contains enzyme preparation in amounts of 0.1 to 12 wt. %, preferably 0.2 to 10 wt. % and in particular 0.5 to 8 wt. %.

As can be seen from the preceding embodiments, the enzyme protein forms only a fraction of the total weight of conventional enzyme preparations. Protease and amylase preparations preferably used according to the invention contain between 0.1 and 40 wt. %, preferably between 0.2 and 30 wt. %, particularly preferably between 0.4 and 20 wt. % and in particular between 0.8 and 10 wt. % of the enzyme protein.

Some further formulations by way of example of preferred automatic dishwashing agents according to the invention can be found in the tables below:

| Ingredient | Form. 1 [wt. %] | Form. 2 [wt. %] | Form. 3 [wt. %] | Form. 4 [wt. %] |
|---|---|---|---|---|
| Citrate | 5 to 60 | 5 to 50 | 5 to 40 | 5 to 30 |
| (Hydrogen) carbonate | 1) | 2) | 2) | 3) |
| EDDS | 3.0 to 35 | 3.0 to 35 | 4.0 to 30 | 8 to 25 |
| Phosphonate | 0 to 8 | 0 to 8 | 0 to 8 | 0 to 8 |
| Sulfo copolymer | 0 to 20 | 0 to 20 | 0 to 20 | 0 to 20 |
| Enzyme preparation(s) | 0.1 to 12 | 0.2 to 10 | 0.2 to 10 | 0.5 to 8 |
| Phosphate | — | — | — | — |
| Bleaching agent | — | — | — | — |
| Misc | to 100 | to 100 | to 100 | to 100 |

| Ingredient | Form. 5 [wt. %] | Form. 6 [wt. %] | Form. 7 [wt. %] | Form. 8 [wt. %] |
|---|---|---|---|---|
| Citrate | 5 to 60 | 5 to 50 | 5 to 40 | 5 to 30 |
| (Hydrogen) carbonate | 1) | 2) | 2) | 3) |
| EDDS | 3.0 to 35 | 3.0 to 35 | 4.0 to 30 | 8 to 25 |
| Phosphonate | 1 to 8 | 1 to 8 | 1.2 to 6 | 1.2 to 6 |
| Sulfo copolymer | 2 to 20 | 2.0 to 20 | 2.0 to 20 | 2.5 to 15 |
| Enzyme preparation(s) | 0.1 to 12 | 0.2 to 10 | 0.2 to 10 | 0.5 to 8 |
| Phosphate | — | — | — | — |
| Bleaching agent | — | — | — | — |
| Misc | to 100 | to 100 | to 100 | to 100 |

1) Weight ratios of (hydrogen) carbonate b) and EDDS c) between 3:5 and 8:1
2) Weight ratios of (hydrogen) carbonate b) and EDDS c) between 1:1 and 6:1
3) Weight ratios of (hydrogen) carbonate b) and EDDS c) between 1:1 and 4:1

In addition to the ingredients previously described, the agents according to the invention can contain further active washing or cleaning substances, preferably from the group of surfactants, enzymes, organic solvents, glass corrosion inhibitors, corrosion inhibitors, scents and perfume carriers. These preferred ingredients are described in more detail below.

All non-ionic surfactants known to the person skilled in the art can be used in principle as non-ionic surfactants. Alkyl glycosides of the general formula $RO(G)_x$ for example are suitable as non-ionic surfactants, in which R denotes a primary straight-chain or methyl-branched aliphatic residue, in particular one methyl-branched in the 2-position, having 8 to 22, preferably 12 to 18 C atoms, and G is the symbol which stands for a glycose unit having 5 or 6 C atoms, preferably for glucose. The degree of oligomerization x, which indicates the distribution of monoglycosides and oligoglycosides, is any number between 1 and 10; x is preferably between 1.2 and 1.4.

Non-ionic surfactants of the amine oxide type, for example N-cocoalkyl-N,N-dimethyl amine oxide and N-tallow alkyl-N,N-dihydroxyethyl amine oxide, and of the fatty acid alkanol amide type can also be suitable. The amount of these non-ionic surfactants is preferably no more than that of the ethoxylated fatty alcohols, in particular no more than half that.

Another class of non-ionic surfactants preferably used, which are used either as the only non-ionic surfactant or in combination with other non-ionic surfactants, are alkoxylated, preferably ethoxylated or ethoxylated and propoxylated, fatty acid alkyl esters, preferably having 1 to 4 carbon atoms in the alkyl chain.

Slightly foaming non-ionic surfactants are used as preferred surfactants. Washing or cleaning agents, in particular cleaning agents for automatic dishwashing, contain to particular advantage non-ionic surfactants from the group of alkoxylated alcohols. Alkoxylated, advantageously ethoxylated, in particular primary alcohols having preferably 8 to 18 C atoms and on average 1 to 12 mol of ethylene oxide (EO) per mol of alcohol are preferably used as non-ionic surfactants, in which the alcohol residue can be linear or preferably methyl-branched in the 2-position or can contain linear and methyl-branched residues in the mixture, such as are conventionally present in oxoalcohol residues. However, alcohol ethoxylates containing linear residues obtained from alcohols of native origin having 12 to 18 C atoms, for example from coconut, palm, tallow or oleyl alcohol, and on average 2 to 8 mol BO per mol of alcohol are particularly preferred. The preferred ethoxylated alcohols include, for example, $C_{12-14}$ alcohols having 3 EO or 4 EO, $C_{9-11}$ alcohol having 7 EO, $C_{13-15}$ alcohols having 3 EO, 5 EO, 7 E) or 8 EO, $C_{12-18}$ alcohols having 3 EO, 5 EO or 7 EO and thereof, such as mixtures of $C_{12-14}$ alcohol having 3 EO and $C_{12-18}$ alcohol having 5 EO. The specified degrees of ethoxylation are statistical averages which for an individual product can correspond to a whole number or a fraction. Preferred alcohol ethoxylates have a narrow homolog distribution (narrow-range ethoxylates, NRE). In addition to these non-ionic surfactants, fatty alcohols having more than 12 EO can also be used. Examples thereof are tallow fatty alcohol having 14 EO, 25 EO, 30 EO or 40 EO.

Ethoxylated non-ionic surfactants obtained from $C_{6-20}$ monohydroxyalkanols or $C_{6-20}$ alkyl phenols or $C_{16-20}$ fatty alcohols and more than 12 mol, preferably more than 15 mol and in particular more than 20 mol of ethylene oxide per mol of alcohol, are therefore used to particular advantage. A particularly preferred non-ionic surfactant is obtained from a straight-chain fatty alcohol having 16 to 20 carbon atoms ($C_{16-20}$ alcohol), preferably a $C_{18}$ alcohol, and at least 12 mol, preferably at least 15 mol and in particular at least 20 mol of ethylene oxide. Of these the so-called narrow-range ethoxylates are particularly preferred.

Non-ionic surfactants having a melting point above room temperature are preferred in particular. Non-ionic surfactant(s) having a melting point above 20° C., preferably above 25° C., particularly preferably between 25 and 60° C. and in particular between 26.6 and 43.3° C., is/are particularly preferred.

Non-ionic surfactants from the group of alkoxylated alcohols, particularly preferably from the group of mixed alkoxylated alcohols and in particular from the group of EO-AO-EO non-ionic surfactants, are likewise used to particular advantage.

The non-ionic surfactant that is solid at room temperature preferably has propylene oxide units in the molecule. Such PO units preferably account for up to 25 wt. %, particularly preferably up to 20 wt. % and in particular up to 15 wt. % of the total molar mass of the non-ionic surfactant. Particularly preferred non-ionic surfactants are ethoxylated monohydroxy alkanols or alkyl phenols, which additionally have polyoxyethylene-polyoxypropylene block copolymer units. The alcohol or alkyl phenol component of such non-ionic surfactant molecules preferably accounts for more than 30 wt. %, particularly preferably more than 50 wt. % and in particular more than 70 wt. % of the total molar mass of such non-ionic surfactants. Preferred agents have the characteristic feature that they contain ethoxylated and propoxylated non-ionic surfactants in which the propylene oxide units in the molecule account for up to 25 wt. %, preferably up to 20 wt. % and in particular up to 15 wt. % of the total molar mass of the non-ionic surfactant.

Surfactants that are preferably used derive from the groups of alkoxylated non-ionic surfactants, in particular the ethoxylated primary alcohols, and mixtures of these surfactants with structurally more complex surfactants such as polyoxypropylene/polyoxyethylene/polyoxypropylene ((PO/EO/PO) surfactants). Such (PO/EO/PO) non-ionic surfactants moreover have very good foam control.

Further non-ionic surfactants that are particularly preferably used having melting points above room temperature contain 40 to 70% of a polyoxypropylene/polyoxyethylene/polyoxypropylene block polymer blend, containing 75 wt. % of a reverse block copolymer of polyoxyethylene and polyoxypropylene comprising 17 mol of ethylene oxide and 44 mol of propylene oxide, and 25 wt % of a block copolymer of polyoxyethylene and polyoxypropylene, initiated with trimethylolpropane and containing 24 mol of ethylene oxide and 99 mol of propylene oxide per mol of trimethylolpropane.

Slightly foaming non-ionic surfactants having alternating ethylene oxide and alkylene oxide units have proved to be particularly preferred non-ionic surfactants within the context of the present invention. Of these, surfactants having EO-AO-EO-AO blocks are in turn preferred, with in each case one to ten EO or AO groups being bound to one another before a block of the other group follows. Non-ionic surfactants of the general formula $$R^1-O-(CH_2-CH_2-O)_w-(CH_2-\underset{\underset{R^2}{|}}{CH}-O)_x-(CH_2-CH_2-O)_y-(CH_2-\underset{\underset{R^3}{|}}{CH}-O)_z-H$$

are preferred here, in which $R^1$ denotes a straight-chain or branched, saturated or mono- or polyunsaturated $C_{6-24}$ alkyl or alkenyl residue; each $R^2$ or $R^3$ group is selected independently of each other from —$CH_3$, —$CH_2CH_3$, —$CH_2CH_2$—$CH_3$, $CH(CH_3)_2$ and the indices w, x, y, z independently of one another denote whole numbers from 1 to 6.

The preferred non-ionic surfactants of the above formula can be produced by known methods from the corresponding $R^1$—OH alcohols and ethylene or alkylene oxide. The residue $R^1$ in the above formula can vary according to the origin of the alcohol. If native sources are used, the residue $R^1$ has an even number of carbon atoms and is generally unbranched, with the linear residues of alcohols of native origin having 12 to 18 C atoms, for example from coconut, palm, tallow or oleyl alcohol, being preferred. Alcohols accessible from synthetic sources are for example the Guerbet alcohols or residues methyl-branched in the 2-position or a mixture of linear and methyl-branched residues, such as are conventionally present in oxoalcohol residues. Irrespective of the nature of the alcohol used to produce the non-ionic surfactants contained in the agents, non-ionic surfactants are preferred in which $R^1$ in the above formula denotes an alkyl residue having 6 to 24, preferably 8 to 20, particularly preferably 9 to 15 and in particular 9 to 11 carbon atoms.

In addition to propylene oxide, butylene oxide in particular is suitable as the alkylene oxide unit contained in alternating order with the ethylene oxide unit in the preferred non-ionic surfactants. However, further alkylene oxides, in which $R^2$ and $R^3$ are selected independently from each other from —$CH_2CH_2$—$CH_3$ and —$CH(CH_3)_2$, are also suitable. Non-ionic surfactants of the above formula are preferably used in which $R^2$ and $R^3$ denote a —$CH_3$ residue, w and x independently of each other denote values of 3 or 4 and y and z independently of each other denote values of 1 or 2.

In summary, non-ionic surfactants are preferred in particular which have a $C_9$-$_{15}$ alkyl residue with 1 to 4 ethylene oxide units, followed by 1 to 4 propylene oxide units, followed by 1 to 4 ethylene oxide units, followed by 1 to 4 propylene oxide units. These surfactants have the necessary low viscosity in aqueous solution and can be used to particular advantage according to the invention.

Surfactants of the general formula $R^1$—$CH(OH)CH_2O$-$(AO)_w$-$(A'O)_x$-$(A''O)_y$-$(A'''O)_z$—$R^2$, in which $R^1$ and $R^2$ independently of each other denote a straight-chain or branched, saturated or mono- or polyunsaturated $C_{2-40}$ alkyl or alkenyl residue; A, A', A'' and A''' independently of one another denote a residue from the group —$CH_2CH_2$, —$CH_2CH_2$—$CH_2$, —$CH_2$—$CH(CH_3)$, —$CH_2$—CH2-$CH_2$—$CH_2$, —$CH_2$—$CH(CH_3)$—$CH_2$—, —$CH_2$—CH($CH_2$—$CH_3$); and w, x, y and z denote values between 0.5 and 90, wherein x, y and/or z can also be 0, are preferred according to the invention.

Such end-capped poly(oxyalkylated) non-ionic surfactants are preferred in particular which according to the formula $R^1O[CH_2CH_2O]_xCH_2CH(OH)R^2$ also have, in addition to a residue $R^1$, which denotes linear or branched, saturated or unsaturated, aliphatic or aromatic hydrocarbon residues having 2 to 30 carbon atoms, preferably 4 to 22 carbon atoms, a linear or branched, saturated or unsaturated, aliphatic or aromatic hydrocarbon residue $R^2$ having 1 to 30 carbon atoms, where x denotes values between 1 and 90, preferably values between 30 and 80 and in particular values between 30 and 60.

Surfactants of the formula $R^1O[CH_2CH(CH_3)O]_x[CH_2CH_2O]_yCH_2CH(OH)R^2$ are particularly preferred, in which $R^1$ denotes a linear or branched aliphatic hydrocarbon residue having 4 to 18 carbon atoms or mixtures thereof, $R^2$ denotes a linear or branched hydrocarbon residue having 2 to 26 carbon atoms or mixtures thereof, and x denotes values between 0.5 and 1.5 and y denotes a value of at least 15.

Also particularly preferred are such end-capped poly(oxyalkylated) non-ionic surfactants of the formula $R^1O[CH_2H_2O]_x[CH_2CH(R^3)O]CH_2CH(OH)R^2$ in which $R^1$ and $R^2$ independently of each other denote a linear or branched, saturated or mono- or polyunsaturated hydrocarbon residue having 2 to 26 carbon atoms, $R^3$ is selected independently from —$CH_3$, —$CH_2CH_3$, —$CH_2CH_2$—$CH_3$, —$CH(CH_3)_2$, but preferably denotes —$CH_3$, and x and y independently of each other denote values between 1 and 32, wherein non-ionic surfactants having $R^3$=—$CH_3$ and values for x of 15 to 32 and y of between 0.5 and 1.5 are most particularly preferred.

Through the use of the non-ionic surfactants described above having a free hydroxyl group at one of the two terminal alkyl residues, the formation of deposits in automatic dishwashing can be markedly improved in comparison to conventional polyalkoxylated fatty alcohols without a free hydroxyl group.

Other non-ionic surfactants that can preferably be used are the end-capped poly(oxyalkylated) non-ionic surfactants of the formula $R^1O[CH_2CH(R^3)O]_x[CH_2]_kCH(OH)[CH_2]_jOR^2$, in which $R^1$ and $R^2$ denote linear or branched, saturated or unsaturated, aliphatic or aromatic hydrocarbon residues having 1 to 30 carbon atoms, $R^3$ denotes H or a methyl, ethyl, n-propyl, isopropyl, n-butyl, 2-butyl or 2-methyl-2-butyl residue, x denotes values between 1 and 30, k and j denote values between 1 and 12, preferably between 1 and 5. If the value x≧2, each $R^3$ in the above formula $R^1O[CH_2CH(R^3)O]_x[CH_2]_kCH(OH)[CH_2]_jOR^2$ can be different. $R^1$ and $R^2$ are preferably linear or branched, saturated or unsaturated, aliphatic or aromatic hydrocarbon residues having 6 to 22 carbon atoms, with residues having 8 to 18 C atoms being particularly preferred. H, —$CH_3$ or —$CH_2CH_3$ are particularly preferred for the residue $R^3$. Particularly preferred values for x are in the range from 1 to 20, preferably 6 to 15.

As is described above, each $R^3$ in the above formula can be different if x≧2. The alkylene oxide unit in the square brackets can be varied in this way. For example, if x denotes 3, the residue $R^3$ can be selected in order to form ethylene oxide ($R^3$=—H) or propylene oxide ($R^3$=$CH_3$) units, which can be combined in any sequence, for example (EO)(PO)(EO), (EO)(EO)(PO), (EO)(EO)(EO), (PO)(EO)(PO), (PO)(PO)(EO) and (PO)(PO)(PO). The value of 3 for x is chosen here by way of example and can certainly be greater, in which case the variation range increases as the value of x increases, and includes for example a large number of (EO) groups combined with a small number of (PO) groups or vice versa.

Particularly preferred end-capped poly(oxyalkylated) alcohols of the above formula have values of k=1 and j=1, so that the above formula can be simplified to $R^1O[CH_2CH(R^3)O]_xCH_2CH(OH)CH_2OR^2$. In this last formula $R^1$, $R^2$ and $R^3$ are as defined above and x denotes values from 1 to 30, preferably from 1 to 20 and in particular from 6 to 18. Surfactants in which residues $R^1$ and $R^2$ have 9 to 14 C atoms, $R^3$ denotes H and x assumes values from 6 to 15 are particularly preferred.

The specified C chain lengths and degrees of ethoxylation or degrees of alkoxylation of the aforementioned non-ionic surfactants are statistical averages which for an individual product can be a whole number or a fraction. By virtue of the method of preparation, commercial products of the cited formulae mostly consist not of a single representative but of mixtures, as a consequence of which averages and hence fractions can occur for both the C chain lengths and the degrees of ethoxylation or degrees of alkoxylation.

A further group of preferred non-ionic surfactants are surfactants of the general formula $R^1O(AlkO)_xM(OAlk)_yOR^2$, in which

- $R^1$ and $R^2$ independently of each other denote a branched or unbranched, saturated or unsaturated, optionally hydroxylated alkyl residue having 4 to 22 carbon atoms;
- Alk denotes a branched or unbranched alkyl residue having 2 to 4 carbon atoms;
- x and y independently of each other denote values between 1 and 70; and
- M denotes an alkyl residue from the group $CH_2$, $CHR^3$, $CR^3R^4$, $CH_2CHR^3$ and $CHR^3CHR^4$, in which $R^3$ and $R^4$ independently of each other denote a branched or unbranched, saturated or unsaturated alkyl residue having 1 to 18 carbon atoms.

In a preferred embodiment the percentage by weight of this specific non-ionic surfactant relative to the total weight of the automatic dishwashing agent according to the invention is between 0.05 and 10 wt. %, by preference between 0.1 and 8 wt. %, preferably between 0.5 and 5 wt. % and in particular between 1 and 3 wt. %.

The group of non-ionic surfactants of the general formula $R^1O(AlkO)_xM(OAlk)_yOR^2$ includes a series of particularly preferred compounds.

In a first preferred embodiment automatic dishwashing agents according to the invention contain as the non-ionic surfactant A a surfactant of the general formula $R^1$—$CH(OH)CH_2$—$O(CH_2CH_2O)_xCH_2CHR(OCH_2CH_2)_yO$—$CH_2CH(OH)$—$R^2$, in which R, $R^1$ and $R^2$ independently of one another denote an alkyl residue or alkenyl residue having 6 to 22 carbon atoms;

x and y independently of each other denote values between 1 and 40.

Compounds of the general formula $R^1$—CH(OH)$CH_2$—O$(CH_2CH_2O)_xCH_2CHR(OCH_2CH_2)_yO$—$CH_2CH(OH)$—$R^2$ are preferred in particular in which R denotes a linear, saturated alkyl residue having 8 to 16 carbon atoms, preferably 10 to 14 carbon atoms, and n and m independently of each other have values of 20 to 30. Corresponding compounds can be obtained for example by reacting alkyl diols HO—CHR—$CH_2$—OH with ethylene oxide, wherein a reaction takes place subsequently with an alkyl epoxide to cap the free OH functions with formation of a dihydroxy ether.

In a further preferred embodiment automatic dishwashing agents according to the invention contain non-ionic surfactant of the general formula $R^1$—$O(CH_2CH_2O)_xCR^3R^4(OCH_2CH_2)_yO$—, in which $R^1$ and $R^2$ independently of each other denote an alkyl residue or alkenyl residue having 4 to 22 carbon atoms;

$R^3$ and $R^4$ independently of each other denote H or an alkyl residue or alkenyl residue having 1 to 18 carbon atoms and x and y independently of each other denote values between 1 and 40.

Compounds of the general formula $R^1$—$O(CH_2CH_2O)_xCR^3R^4(OCH_2CH_2)_yO$—$R^2$ are preferred in particular in which $R^3$ and $R^4$ denote H and the indices x and y independently of each other assume values from 1 to 40, preferably from 1 to 15.

Compounds of the general formula $R^1$—$O(CH_2CH_2O)_xCR^3R^4(OCH_2CH_2)_yO$—$R^2$ are preferred in particular in which the residues $R^1$ and $R^2$ independently of each other denote saturated alkyl residues having 4 to 14 carbon atoms and the indices x and y independently of each other assume values from 1 to 15 and in particular from 1 to 12.

Further preferred are such compounds of the general formula $R^1$—$O(CH_2CH_2O)_xCR^3R^4(OCH_2CH_2)_yO$—$R^2$ in which one of the residues $R^1$ and $R^2$ is branched.

Compounds of the general formula $R^1$—$O(CH_2CH_2O)_xCR^3R^4(OCH_2CH_2)_yO$—$R^2$ are most particularly preferred in which the indices x and y independently of each other assume values from 8 to 12.

The aforementioned non-ionic surfactants can of course be used not only as individual substances but also as mixtures of surfactants comprising two, three, four or more surfactants. The term mixtures of surfactants refers here not to mixtures of non-ionic surfactants which in their entirety come under one of the aforementioned general formulae but rather mixtures containing two, three, four or more non-ionic surfactants which can be described by various of the aforementioned general formulae.

In a preferred embodiment the percentage by weight of non-ionic surfactants relative to the total weight of the automatic dishwashing agent according to the invention is between 0.1 and 15 wt. %, by preference between 0.2 and 10 wt. %, preferably between 0.5 and 8 wt. % and in particular between 1.0 and 6 wt. %.

A particularly preferred automatic dishwashing agent according to the invention comprises a) 5 to 40 wt. % of citrate b) 0.1 to 8 wt. % of amylase and/or protease enzyme preparation c) 4.0 to 30 wt. % of ethylenediamine disuccinic acid d) (hydrogen) carbonate e) 2.0 to 20 wt. % of anionic copolymer, comprising i) mono- or polyunsaturated monomers from the group of carboxylic acids ii) mono- or polyunsaturated monomers from the group of sulfonic acids iii) optionally further ionic or non-ionic monomers f) 0.2 to 10 wt. % of non-ionic surfactant wherein the weight ratio of components b) and c) is between 1:1 and 6:1. Some further formulations by way of example of preferred automatic dishwashing agents according to the invention can be found in the tables below:

| Ingredient | Form. 1 [wt. %] | Form. 2 [wt. %] | Form. 3 [wt. %] | Form. 4 [wt. %] |
|---|---|---|---|---|
| Citrate | 5 to 60 | 5 to 50 | 5 to 40 | 5 to 30 |
| (Hydrogen) carbonate | 1) | 2) | 2) | 3) |
| EDDS | 3.0 to 35 | 3.0 to 35 | 4.0 to 30 | 8 to 25 |
| Phosphonate | 0 to 8 | 0 to 8 | 0 to 8 | 0 to 8 |
| Sulfo copolymer | 0 to 20 | 0 to 20 | 0 to 20 | 0 to 20 |
| Non-ionic surfactant | 0.1 to 15 | 0.1 to 15 | 0.5 to 8 | 0.5 to 8 |
| Enzyme preparation(s) | 0 to 12 | 0 to 12 | 0 to 8 | 0 to 8 |
| Phosphate | — | — | — | — |
| Bleaching agent | — | — | — | — |
| Misc | to 100 | to 100 | to 100 | to 100 |

| Ingredient | Form. 5 [wt. %] | Form. 6 [wt. %] | Form. 7 [wt. %] | Form. 8 [wt. %] |
|---|---|---|---|---|
| Citrate | 5 to 60 | 5 to 50 | 5 to 40 | 5 to 30 |
| (Hydrogen) carbonate | 1) | 2) | 2) | 3) |
| EDDS | 3.0 to 35 | 3.0 to 35 | 4.0 to 30 | 8 to 25 |
| Phosphonate | 1 to 8 | 1 to 8 | 1.2 to 6 | 1.2 to 6 |
| Sulfo copolymer | 2 to 20 | 2.0 to 20 | 2.0 to 20 | 2.5 to 15 |
| Non-ionic surfactant | 0.1 to 15 | 0.1 to 15 | 0.5 to 8 | 0.5 to 8 |
| Enzyme preparation(s) | 0.1 to 12 | 0.2 to 10 | 0.2 to 10 | 0.5 to 8 |
| Phosphate | — | — | — | — |
| Bleaching agent | — | — | — | — |
| Misc | to 100 | to 100 | to 100 | to 100 |

1) Weight ratios of (hydrogen) carbonate b) and EDDS c) between 3:5 and 8:1

2) Weight ratios of (hydrogen) carbonate b) and EDDS c) between 1:1 and 6:1

3) Weight ratios of (hydrogen) carbonate b) and EDDS c) between 1:1 and 4:1

It was found that the cleaning performance of automatic dishwashing agents according to the invention can be improved by the addition of organic solvents.

These organic solvents derive for example from the groups of monoalcohols, diols, triols or polyols of ethers, esters and/or amides. Organic solvents which are water-soluble are particularly preferred, wherein "water-soluble" solvents within the meaning of the present application are solvents which at room temperature are completely miscible with water, i.e. with no miscibility gaps.

Organic solvents which can be used in the agents according to the invention preferably derive from the group of monohydric or polyhydric alcohols, alkanolamines or glycol ethers, provided that they are miscible with water in the specified concentration range. The solvents are preferably selected from ethanol, n- or i-propanol, butanols, glycol, propane- or butanediol, glycerol, diglycol, propyl or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol methyl or ethyl ether, methoxy, ethoxy or butoxy triglycol, 1-butoxyethoxy-2-propanol, 3-methyl-3-methoxybutanol, propylene glycol-t-butyl ether and mixtures of these solvents.

The organic solvents from the group of organic amines and/or alkanolamines have proved to be particularly effective with regard to cleaning performance and here in turn with regard to cleaning performance on bleachable stains, in particular on tea stains.

Primary and secondary alkyl amines, alkylene amines and mixtures of these organic amines are preferred in particular as organic amines. The group of preferred primary alkyl amines includes monomethylamine, monoethylamine, monopropylamine, monobutylamine, monopentylamine and cyclohexylamine. The group of preferred secondary alkyl amines includes in particular dimethylamine.

Preferred alkanolamines are in particular primary, secondary and tertiary alkanolamines and mixtures thereof. Particularly preferred primary alkanolamines are monoethanolamine (2-aminoethanol, MEA), monoisopropanolamine, diethylethanolamine (2-(diethylamino)ethanol). Particularly preferred secondary alkanolamines are diethanolamine (2,2'-iminodiethanol, DEA, bis(2-hydroxyethyl)amine), N-methyl diethanolamine, N-ethyl diethanolamine, diisopropanolamine and morpholine. Particularly preferred tertiary alkanolamines are triethanolamine and triisopropanolamine.

Automatic dishwashing agents wherein relative to their total weight they contain organic amine and/or alkanolamine, preferably ethanolamine, in amounts of 0.1 to 15 wt. %, preferably 0.2 to 10 wt. %, particularly preferably 0.5 to 8 wt. % and in particular 1.0 to 6 wt. %, are particularly preferred according to the invention.

Some further formulations by way of example of preferred automatic dishwashing agents according to the invention can be found in the tables below:

| Ingredient | Form. 1 [wt. %] | Form. 2 [wt. %] | Form. 3 [wt. %] | Form. 4 [wt. %] |
|---|---|---|---|---|
| Citrate | 5 to 60 | 5 to 50 | 5 to 40 | 5 to 30 |
| (Hydrogen) carbonate | 1) | 2) | 2) | 3) |
| EDDS | 3.0 to 35 | 3.0 to 35 | 4.0 to 30 | 8 to 25 |
| Phosphonate | 0 to 8 | 0 to 8 | 0 to 8 | 0 to 8 |
| Sulfo copolymer | 0 to 20 | 0 to 20 | 0 to 20 | 0 to 20 |
| Non-ionic surfactant | 0 to 15 | 0 to 15 | 0 to 8 | 0 to 8 |
| Enzyme preparation(s) | 0 to 12 | 0 to 12 | 0 to 8 | 0 to 8 |
| Org. solvent | 0.1 to 15 | 0.2 to 10 | 0.5 to 8.0 | 1.0 to 6.0 |
| Phosphate | — | — | — | — |
| Bleaching agent | — | — | — | — |
| Misc | to 100 | to 100 | to 100 | to 100 |

| Ingredient | Form. 5 [wt. %] | Form. 6 [wt. %] | Form. 7 [wt. %] | Form. 8 [wt. %] |
|---|---|---|---|---|
| Citrate | 5 to 60 | 5 to 50 | 5 to 40 | 5 to 30 |
| (Hydrogen) carbonate | 1) | 2) | 2) | 3) |
| EDDS | 3.0 to 35 | 3.0 to 35 | 4.0 to 30 | 8 to 25 |
| Phosphonate | 1 to 8 | 1 to 8 | 1.2 to 6 | 1.2 to 6 |
| Sulfo copolymer | 2 to 20 | 2.0 to 20 | 2.0 to 20 | 2.5 to 15 |
| Non-ionic surfactant | 0.1 to 15 | 0.1 to 15 | 0.5 to 8 | 0.5 to 8 |
| Enzyme preparation(s) | 0.1 to 12 | 0.2 to 10 | 0.2 to 10 | 0.5 to 8 |
| Org. solvent | 0.1 to 15 | 0.2 to 10 | 0.5 to 8.0 | 1.0 to 6.0 |
| Phosphate | — | — | — | — |
| Bleaching agent | — | — | — | — |
| Misc | to 100 | to 100 | to 100 | to 100 |

1) Weight ratios of (hydrogen) carbonate b) and EDDS c) between 3:5 and 8:1
2) Weight ratios of (hydrogen) carbonate b) and EDDS c) between 1:1 and 6:1
3) Weight ratios of (hydrogen) carbonate b) and EDDS c) between 1:1 and 4:1

The automatic dishwashing agents according to the invention can exist in usage forms known to the person skilled in the art, thus for example in solid or liquid form but also as a combination of solid and liquid product forms.

Powders, granules, extrudates or compacted products, in particular tablets, are suitable in particular as solid product forms. The liquid product forms based on water and/or organic solvents can exist in thickened form, in the form of gels.

Agents according to the invention can be made up as single-phase or multi-phase products. Automatic dishwashing agents with one, two, three or four phases are preferred in particular. Automatic dishwashing agents wherein they exist in the form of a ready-to-use dosing unit with two or more phases are particularly preferred.

The individual phases of multi-phase agents can have identical or different states of aggregation. Automatic dishwashing agents having at least two different solid phases and/or at least two liquid phases and/or at least one solid and at least one liquid phase are preferred in particular. Two-phase or multi-phase tablets, for example two-layer tablets, in particular two-layer tablets having a depression and a molding positioned in the depression, are particularly preferred in particular.

Automatic dishwashing agents according to the invention are preferably made up in advance into dosing units. These dosing units preferably comprise the amount of active washing or cleaning substances necessary for one cleaning cycle. Preferred dosing units have a weight of between 12 and 30 g, preferably between 14 and 26 g and in particular between 15 and 22 g.

The volume of the aforementioned dosing units and their shape are chosen to particular advantage such that the ready-to-use units can be introduced via the dosing chamber of a dishwasher. The volume of the dosing unit is therefore preferably between 10 and 35 ml, by preference between 12 and 30 ml and in particular between 15 and 25 ml.

The automatic dishwashing agents according to the invention, in particular the ready-to-use dosing units, have a water-soluble wrapper to particular advantage.

To make it easier for ready-to-use moldings to break down, it is possible to incorporate disintegrating agents known as tablet disintegrants into these agents to reduce breakdown times.

These substances, which have an explosive action, increase in volume on admission of water, wherein on the one hand their own volume increases (swelling) and on the other hand a pressure can also be generated via the release of gases which causes the tablet to break down into smaller particles. Well-known disintegrating agents are for example carbonate/citric acid systems, wherein other organic acids can also be used. Swelling disintegrating agents are for example synthetic polymers such as polyvinyl pyrrolidone (PVP) or natural polymers or modified natural substances such as cellulose and starch and derivatives thereof, alginates or casein derivatives.

Disintegrating agents are preferably used in amounts of 0.5 to 10 wt. %, preferably 3 to 7 wt. % and in particular 4 to 6 wt. %, relative in each case to the total weight of the disintegrating agent-containing agent.

Disintegrating agents based on cellulose are used as preferred disintegrating agents, such that preferred washing or cleaning agents contain such a cellulose-based disintegrating agent in amounts of 0.5 to 10 wt. %, preferably 3 to 7 wt. % and in particular 4 to 6 wt. %. The cellulose used as a disintegrating agent is preferably used not in fine-particle form but rather is converted into a coarser form, for example granulated or compacted, before being added to the premixes to be molded. The particle sizes of such disintegrating agents are mostly above 200 μm, preferably with at least 90 wt. % between 300 and 1600 μm and in particular with at least 90 wt. % between 400 and 1200 μm.

Preferred disintegrating agents, preferably a cellulose-based disintegrating agent, preferably in granular, cogranulated or compacted form, are included in the disintegrating agent-containing agents in amounts of 0.5 to 10 wt. %, preferably 3 to 7 wt. % and in particular 4 to 6 wt. %, relative in each case to the total weight of the disintegrating agent-containing agent.

According to the invention gas-generating effervescent systems can moreover also be used by preference as tablet disintegrating agents. Preferred effervescent systems consist however of at least two constituents which react together with formation of gas, for example alkali metal carbonate and/or alkali hydrogen carbonate, and an acidifying agent which is suitable for releasing carbon dioxide from the alkali metal salts in aqueous solution. An acidifying agent which releases carbon dioxide from the alkali salts in aqueous solution is citric acid, for example.

Some further formulations by way of example of preferred solid automatic dishwashing agents according to the invention can be found in the tables below:

| Ingredient | Form. 1 [wt. %] | Form. 2 [wt. %] | Form. 3 [wt. %] | Form. 4 [wt. %] |
|---|---|---|---|---|
| Citrate (Hydrogen) carbonate | 5 to 60 1) | 5 to 50 2) | 5 to 40 2) | 5 to 30 3) |
| EDDS | 3.0 to 35 | 3.0 to 35 | 4.0 to 30 | 8 to 25 |
| Phosphonate | 0 to 8 | 0 to 8 | 0 to 8 | 0 to 8 |
| Sulfo copolymer | 0 to 20 | 0 to 20 | 0 to 20 | 0 to 20 |
| Non-ionic surfactant | 0 to 15 | 0 to 15 | 0 to 8 | 0 to 8 |
| Enzyme preparation(s) | 0 to 12 | 0 to 12 | 0 to 8 | 0 to 8 |
| Phosphate | — | — | — | — |
| Bleaching agent | — | — | — | — |
| Misc | to 100 | to 100 | to 100 | to 100 |

| Ingredient | Form. 5 [wt. %] | Form. 6 [wt. %] | Form. 7 [wt. %] | Form. 8 [wt. %] |
|---|---|---|---|---|
| Citrate (Hydrogen) carbonate | 5 to 60 1) | 5 to 50 2) | 5 to 40 2) | 5 to 30 3) |
| EDDS | 3.0 to 35 | 3.0 to 35 | 4.0 to 30 | 8 to 25 |
| Phosphonate | 1 to 8 | 1 to 8 | 1.2 to 6 | 1.2 to 6 |
| Sulfo copolymer | 2 to 20 | 2.0 to 20 | 2.0 to 20 | 2.5 to 15 |
| Non-ionic surfactant | 0.1 to 15 | 0.1 to 15 | 0.5 to 8 | 0.5 to 8 |
| Enzyme preparation(s) | 0.1 to 12 | 0.2 to 10 | 0.2 to 10 | 0.5 to 8 |
| Phosphate | — | — | — | — |
| Bleaching agent | — | — | — | — |
| Misc | to 100 | to 100 | to 100 | to 100 |

1) Weight ratios of (hydrogen) carbonate b) and EDDS c) between 3:5 and 8:1
2) Weight ratios of (hydrogen) carbonate b) and EDDS c) between 1:1 and 6:1
3) Weight ratios of (hydrogen) carbonate b) and EDDS c) between 1:1 and 4:1

In an alternative embodiment the automatic dishwashing agents according to the invention exist in liquid form. Preferred liquid product forms are based on an aqueous matrix which optionally contains proportions of organic solvents.

A particularly preferred liquid automatic dishwashing agent according to the invention comprises a) 5 to 40 wt. % of citrate b) 0.1 to 8 wt. % of amylase and/or protease enzyme preparation c) 4.0 to 30 wt. % of ethylenediamine disuccinic acid d) (hydrogen) carbonate e) 2.0 to 20 wt. % of anionic copolymer, comprising i) mono- or polyunsaturated monomers from the group of carboxylic acids ii) mono- or polyunsaturated monomers from the group of sulfonic acids iii) optionally further ionic or non-ionic monomers f) 0.2 to 10 wt. % of non-ionic surfactant g) 20 to 70 wt. % of water, wherein the weight ratio of components b) and c) is between 1:1 and 6:1.

Some further formulations by way of example of preferred liquid automatic dishwashing agents according to the invention can be found in the tables below:

| Ingredient | Form. 1 [wt. %] | Form. 2 [wt. %] | Form. 3 [wt. %] | Form. 4 [wt. %] |
|---|---|---|---|---|
| Citrate (Hydrogen) carbonate | 5 to 60 1) | 5 to 50 2) | 5 to 40 2) | 5 to 30 3) |
| EDDS | 3.0 to 35 | 3.0 to 35 | 4.0 to 30 | 8 to 25 |
| Phosphonate | 0 to 8 | 0 to 8 | 0 to 8 | 0 to 8 |
| Sulfo copolymer | 0 to 20 | 0 to 20 | 0 to 20 | 0 to 20 |
| Non-ionic surfactant | 0 to 15 | 0 to 15 | 0 to 8 | 0 to 8 |
| Enzyme preparations) | 0 to 12 | 0 to 12 | 0 to 8 | 0 to 8 |
| Org. solvent | 0 to 15 | 0 to 15 | 0 to 15 | 0 to 15 |
| Phosphate | — | — | — | — |
| Bleaching agent | — | — | — | — |
| Water | 20 to 80 | 20 to 80 | 30 to 70 | 40 to 60 |
| Misc | to 100 | to 100 | to 100 | to 100 |

| Ingredient | Form. 5 [wt. %] | Form. 6 [wt. %] | Form. 7 [wt. %] | Form. 8 [wt. %] |
|---|---|---|---|---|
| Citrate (Hydrogen) carbonate | 5 to 60 1) | 5 to 50 2) | 5 to 40 2) | 5 to 30 3) |
| EDDS | 3.0 to 35 | 3.0 to 35 | 4.0 to 30 | 8 to 25 |
| Phosphonate | 1 to 8 | 1 to 8 | 1.2 to 6 | 1.2 to 6 |
| Sulfo copolymer | 2 to 20 | 2.0 to 20 | 2.0 to 20 | 2.5 to 15 |
| Non-ionic surfactant | 0.1 to 15 | 0.1 to 15 | 0.5 to 8 | 0.5 to 8 |
| Enzyme preparation(s) | 0.1 to 12 | 0.1 to 12 | 0.5 to 8 | 0.5 to 8 |
| Org. solvent | 0 to 15 | 0 to 15 | 0 to 15 | 0 to 15 |
| Phosphate | — | — | — | — |
| Bleaching agent | — | — | — | — |
| Water | 20 to 80 | 20 to 80 | 30 to 70 | 40 to 60 |
| Misc | to 100 | to 100 | to 100 | to 100 |

1) Weight ratios of (hydrogen) carbonate b) and EDDS c) between 3:5 and 8:1
2) Weight ratios of (hydrogen) carbonate b) and EDDS c) between 1:1 and 6:1
3) Weight ratios of (hydrogen) carbonate b) and EDDS c) between 1:1 and 4:1

If the agents according to the invention are in liquid form, these agents preferably contain 20 to 80 wt. %, by preference 30 to 70 wt. % and in particular 40 to 60 wt. % of water. The dosing units of these liquid product forms preferably comprise the amount of active washing or cleaning substances necessary for one cleaning cycle. Preferred liquid dosing units have a weight of between 25 and 60 g, preferably between 30 and 55 g and in particular between 55 and 50 g.

The combinations of active ingredients described above are suitable in particular for cleaning dishes in automatic dishwashing methods. The present application also provides a method for cleaning dishes in a dishwasher using an automatic dishwashing agent according to the invention, wherein the automatic dishwashing agents are preferably introduced into the interior of a dishwasher during the course of a dishwashing program, before the start of the main wash cycle or during the main wash cycle. The introduction or insertion of the agent according to the invention into the interior of the dishwasher can take place manually, but the agent is preferably introduced into the interior of the dishwasher via the dosing chamber of the dishwasher. During the course of the cleaning method, no additional water softener and no additional rinse aid is preferably introduced into the interior of the dishwasher. This application also provides a kit for a dishwasher, comprising a) an automatic dishwashing agent according to the invention;

b) a guide which tells the consumer to use the automatic dishwashing agent without the addition of rinse aid and/or softener salt.

The automatic dishwashing agents according to the invention exhibit their advantageous cleaning and drying properties in particular also in low-temperature cleaning methods. Preferred dishwashing methods using agents according to the invention therefore have the characteristic feature that the dishwashing methods are performed at a liquor temperature below 60° C., preferably below 50° C.

As described in the introduction, agents according to the invention have the characteristic feature of improved tea stain removal as compared with conventional automatic dishwashing agents. The present application therefore also provides the use of an automatic dishwashing agent according to the invention to improve tea stain removal in automatic dishwashing.

EXAMPLES

In an automatic dishwashing method dirty dishes were washed in a dishwasher (Miele G 698) with a water hardness of 21° dH and at a temperature of 50° C. with 42.5 g ml of the automatic dishwashing agents listed in the table below.

| Ingredient | C1 | C2 | E1 | E2 | E3 |
|---|---|---|---|---|---|
| | Figures in wt. % | | | | |
| Potassium tripolyphosphate | 28 | — | — | — | — |
| Sodium citrate | — | 9.0 | 9.0 | 9.0 | 9.0 |
| Potassium hydroxide | 5.5 | 7.0 | 7.0 | 7.0 | 6.0 |
| Sodium carbonate | 4.0 | 14 | 4.0 | 14 | 14 |
| Ethylenediamine disuccinic acid | — | — | 10 | 10 | 10 |
| Sulfo polymer | 4.2 | 4.2 | 4.2 | 4.2 | — |
| HEDP | 2.0 | 1.5 | 1.5 | 1.5 | 1.5 |
| Non-ionic surfactant | 2.0 | 2.0 | 2.0 | 2.0 | 2.0 |
| Protease preparation | 2.0 | 2.0 | 2.0 | 2.0 | 2.0 |
| Amylase preparation | 0.8 | 0.8 | 0.8 | 0.8 | 0.8 |
| Alkanolamine | 1.5 | 1.5 | 1.5 | 1.5 | 1.5 |
| Thickener | 2.0 | 2.0 | 2.0 | 2.0 | 2.0 |
| Water, misc | to 100 | to 100 | to 100 | to 100 | to 100 |

The cleaning performance of the automatic dishwashing agents was assessed by means of the IKW (Industrieverband Korperpflege- and Waschmittel e.V.) method. The results are shown in the table below (the specified values are the averages from 3 tests).

| Cleaning performance | C1 | C2 | E1 | E2 | E3 |
|---|---|---|---|---|---|
| Tea | 4.0 | 1.0 | 2.0 | 3.0 | 1.5 |

(Cleaning performance rating scale: 10 = no staining to 0 = heavy staining)

| Cleaning performance | C1 | C2 | E1 |
|---|---|---|---|
| Milk | 7 | 8 | 8 |
| Starch | 9 | 9 | 10 |

(Cleaning performance rating scale: 10 = no staining to 0 = heavy staining)

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A phosphate- and bleaching agent-free automatic dishwashing agent containing:

a) 5 to 60 wt. % of citrate;

b) (hydrogen) carbonate; and c) 2 to 40 wt. % of ethylenediamine disuccinic acid, wherein the weight ratio of components b) and c) is between 1:5 and 10:1.

2. The automatic dishwashing agent according to claim 1, wherein relative to its total weight the automatic dishwashing agent contains 5 to 50 wt. % of citrate.

3. The automatic dishwashing agent according to claim 1, wherein relative to its total weight the automatic dishwashing agent contains 2.0 to 50 wt. % of (hydrogen) carbonate.

4. The automatic dishwashing agent according to claim 1, wherein relative to its total weight the automatic dishwashing agent contains 3.0 to 35 wt. %.

5. The automatic dishwashing agent according to claim 1, wherein the weight ratio of components b) and c) is between 3:5 and 8:1.

6. The automatic dishwashing agent according claim 1, wherein relative to its total weight the automatic dishwashing agent contains 2.0 to 20 wt. % of anionic copolymer, comprising i) mono- or polyunsaturated monomers from the group of carboxylic acids, ii) mono- or polyunsaturated monomers from the group of sulfonic acids, and iii) optionally further ionic or non-ionic monomers.

7. The automatic dishwashing agent according to claim 1, further comprising one or more enzymes, wherein relative to the total weight of the dishwashing agent the one or more enzymes are included at a concentration ranging between 0.1 and 12 wt. %.

8. The automatic dishwashing agent according to claim 1, further comprising a phosphonate at a concentration ranging between 1 and 8 wt. % relative to the total weight the dishwashing agent.

9. The automatic dishwashing agent according to claim 1 further comprising a nonionic surfactant at a concentration ranging between 0.1 and 15 wt. % relative to the total weight the dishwashing agent.

10. The automatic dishwashing agent according to claim 1, further comprising a non-ionic surfactant A of the general formula $R^1O(AlkO)_xM(OAlk)_yOR^2$ in which $R^1$ and $R^2$ independently of each other denote a branched or unbranched, saturated or unsaturated, optionally hydroxylated alkyl residue having 4 to 22 carbon atoms;

Alk denotes a branched or unbranched alkyl residue having 2 to 4 carbon atoms;

x and y independently of each other denote values between 1 and 70; and

M denotes an alkyl residue from the group $CH_2$, $CHR^3$, $CR^3R^4$, $CH_2CHR^3$ and $CHR^3CHR^4$, in which $R^3$ and $R^4$ independently of each other denote a branched or unbranched, saturated or unsaturated alkyl residue having 1 to 18 carbon atoms.

11. The automatic dishwashing agent according to claim 1, further comprising an organic amine and/or an alkanolamine, preferably ethanolamine, in amounts of 0.1 to 15 wt. % relative to the total weight of the dishwashing agent.

12. The automatic dishwashing agent according to claim 1, comprising:

a) 5 to 40 wt. % of the citrate;

b) the (hydrogen) carbonate;

c) 4.0 to 30 wt. % of the ethylenediamine disuccinic acid;

d) 0.1 to 8 wt. % of an amylase and/or protease enzyme preparation;

e) 2.0 to 20 wt. % of an anionic copolymer, comprising i) mono- or polyunsaturated monomers from the group of carboxylic acids, ii) mono- or polyunsaturated monomers from the group of sulfonic acids, and iii) optionally further ionic or non-ionic monomers; and f) 0.2 to 10 wt. % of a non-ionic surfactant, wherein the weight ratio of components b) and c) is between 1:1 and 6:1.

13. A liquid automatic dishwashing agent according to claim 1, comprising:

a) 5 to 40 wt. % of the citrate;

b) the (hydrogen) carbonate;

c) 4.0 to 30 wt. % of the ethylenediamine disuccinic acid;

d) 0.1 to 8 wt. % of an amylase and/or protease enzyme preparation;

e) 2.0 to 20 wt. % of anionic copolymer, comprising i) mono- or polyunsaturated monomers from the group of carboxylic acids, ii) mono- or polyunsaturated monomers from the group of sulfonic acids, and iii) optionally further ionic or non-ionic monomers;

f) 0.2 to 10 wt. % of non-ionic surfactant; and g) 20 to 70 wt. % of water, wherein the weight ratio of components b) and c) is between 1:1 and 6:1.

14. A method for washing dishes, comprising the step of:

washing the dishes in a dishwasher using the automatic dishwashing agent according to claim 1.

* * * * *